United States Patent [19]

Barone et al.

[11] Patent Number: 4,806,273

[45] Date of Patent: Feb. 21, 1989

[54] BREAKAGE RESISTANT HIGHER FATTY ALCOHOL SULFATE DETERGENT LAUNDRY BARS

[75] Inventors: Patrizia Barone, Piscataway; Pallassana N. Ramachandran, Robbinsville, both of N.J.

[73] Assignee: Colgate-Palmolive Company, Piscataway, N.J.

[21] Appl. No.: 74,587

[22] Filed: Jul. 17, 1987

Related U.S. Application Data

[63] Continuation of Ser. No. 836,890, Mar. 6, 1986, abandoned.

[51] Int. Cl.[4] ..... C11D 17/00

[52] U.S. Cl. ..... 252/544; 252/135; 252/139; 252/140; 252/154; 252/163; 252/174; 252/174.25; 252/525; 252/531; 252/DIG. 16

[58] Field of Search ..... 252/134, 135, 531, 139, 252/140, 525, 544, 154, 163, 174, 174.25, DIG. 16

[56] References Cited

U.S. PATENT DOCUMENTS

| | | | |
|---|---|---|---|
| 2,941,948 | 6/1960 | Blinka et al. | 252/135 |
| 4,543,204 | 9/1985 | Gervasio | 252/531 |

*Primary Examiner*—Paul Lieberman
*Assistant Examiner*—Hoa Van Le
*Attorney, Agent, or Firm*—Murray M. Grill; Bernard Lieberman

[57] ABSTRACT

Detergent laundry bars of improved physical characteristics, including improved resistance to breakage on handling, are described which include 10 to 35% of sodium higher fatty alcohol sulfate detergent, 10 to 60% of builder for the detergent mixture, a bodying proportion, in the range of 10 to 60% of water insoluble powder, 1 to 10% of higher fatty lower alkanolamide, 0.2 to 5% of glycerol, with the ratio of alkanolamide to glycerol being in the range of 1:5 to 25:1, and 5 to 20% of water (including that which is removable from any hydrate components when the bar is subjected to heating at 105° C. for two hours). Preferably the invented bars will comprise 10 to 25% of sodium coco alcohol sulfate or equivalent sodium higher fatty alcohol sulfate, up to 5 or 10% of secondary detergents, 15 to 30% of sodium tripolyphosphate, 5 to 25% of sodium carbonate, 0 to 10% of sodium silicate, 10 to 50% of calcium carbonate powder, 3 to 7% of cocomonoethanolamide; 0.3 to 1% of glycerol, with the ratio of cocomonoethanolamide:glycerol being in the range of 2:1 to 25:1, and 5 to 12% of water. The described bars, which preferably are milled and plodded, exhibit better resistance to breakage on handling than do bars of similar formulas which do not contain the ethanolamide and glycerol, which is very surprising. They are also of acceptable hardness and do not slough or erode excessively on standing in contact with water, and in use. The bars process satisfactorily and foam well, too.

6 Claims, No Drawings

BREAKAGE RESISTANT HIGHER FATTY ALCOHOL SULFATE DETERGENT LAUNDRY BARS

This is a continuation of application Ser. No. 836,890, filed Mar. 6, 1986, now abandoned.

This invention relates to detergent laundry bars. More particularly, it relates to built detergent laundry bars based on higher fatty alcohol sufate and detergent. Such bars, which also contain builder, bodying agent, alkanolamide, glycerol and water, are superior in various important characteristics to bars of the same formula except for omissions of the alkanolamide and glycerol. Important properties in which the invented bars are superior include: resistance to breakage on handling (and during shipping and storage); hand wash foaming properties (initial foaming, persistence of foaming, and regeneration of foam when the wash water is re-used), hardness; resistance to sloughing and erosion; and processability.

Soap bars have for long been employed for washing the human body and for "doing laundry". Before the advent of washing machines dictated the employment of detersive materials in powder, disintegrable briquette, or liquid forms, laundry was washed with "laundry soap" bars made from suitable soaps of higher fatty acids, such as sodium soaps of mixed tallow and rosin fatty acids. Such laundry soap bars were especially suitable for being rubbed onto badly stained or soiled portions of fabrics being laundered, as on a washboard, to deposit a high concentration of the soap on the soiled area, and they provided mechanical means for applying energy to such surfaces to assist in removing the stains and soils.

Despite the fact that after the introduction of synthetic organic detergents and washing machines the amount of soap employed for laundry use diminished greatly, soap in bar or cake form is still the personal cleaning agent of choice in most of the world, and laundry soaps and detergents in bar form are also still preferred by many consumers in some regions. Detergent laundry bars based on alkylbenzene sulfonate detergents have been successfully marketed. They have been characterized as the equivalents in washing abilities of powdered laundry detergents based on similar alkylbenzene sulfonates, and are considered by many consumers to be more convenient to use. To use them does not require a washing machine and, as was previously indicated, the bar form of the product allows it to be used in such manner that a comparatively high concentration of detersive material may be readily applied to a heavily stained or soiled area with accompanying physical force or energy, as on a washboard, so as more readily to loosen and remove such soil or stain.

Although branched chain higher alkylbenzene sulfonate detergents, such as sodium dodecylbenzene sulfonate (the dodecyl is often highly branched propylene tetramer but can be linear too), make satisfactory detergent laundry bars, such detergents have sometimes been found to be environmentally, ecologically, or economically unacceptable, and accordingly, efforts have been made to formulate detergent laundry bars based on other synthetic organic detergents which would be less objectionable or would be unobjectionable in such respects. Among leading candidates for use as such a detergent are the higher fatty alcohol (or alkyl) sulfates, especially the sodium salts, which are biodegradable and have been successfully employed in various detergent compositions. However, such higher fatty alkyl sulfates had been found to be susceptible to breaking and to becoming damaged during handling after storage and before final use. It was observed that they appeared to change physical properties after manufacture and became prone to excessive breakage during ordinary shipping and handling. Additionally, such products were often not as satisfactorily foaming as analogous laundry bars based on alkylbenzene sulfonate detergents. One solution to this problem is disclosed in U.S. Pat. No. 4,543,204 which teaches the incorporation of higher fatty acids in the bar formula to counteract the tendency of higher fatty alcohol sulfate laundry bars to crack or break during storage and shipment. The patent also mentions that the fatty acid improves foaming characteristics of the fatty alcohol sulfate bars. However, the present invention prevents breakage of the higher fatty alcohol sulfate detergent laundry bars, further improves foaming characteristics of such bars, reduces tendencies of such bars to slough and erode excessively during use, hardens such bars, and improves their processability In accordance with the present invention a detergent laundry bar based on higher fatty alcohol sulfate detergent, which is of improved physical characteristics, including resistance to breakage on handling, comprises 10 to 35% of higher fatty alcohol sulfate detergent, 10 to 60% of builder for the detergent mixture, a bodying proportion, in the range of 10 to 60% of water insoluble powder, 1 to 10% of higher fatty lower alkanolamide, 0.2 to 5% of glycero, with the ratio of alkanolamide to glycerol being in the range of 1:5 to 25:1 and 5 to 20% of water, which water includes water removable from any hydrate components of the detergent laundry bar when such bar is subjected to heating at 105° C. for two hours. Preferably the detergent laundry bars are milled and plodded and comprise 10 to 25% of sodium coco alcohol sulfate or equivalent sodium higher fatty alcohol sulfate, up to 5 or 10% of secondary detergents, 15 to 30% of sodium tripolyphosphate, 5 to 25% of sodium carbonate, 0 to 10% of sodium silicate, 10 to 50% of calcium carbonate powder, 3 to 7% of cocomonoethanolamide; 0.3 to 1% of glycerol, with the ratio of cocomonoethanolamide:glycerol being the range of 2:1 to 25:1, and 5 to 12% of water. Also within the invention is a process for manufacturing a detergent laundry bar of the invention which comprises mixing together the components of the present final product, with a slight excess of water, e.g., 1 to 3%, to compensate for processing losses, plodding the mixture, extruding it in bar form and cutting the bar to desired lengths. Preferably, the mixture of components of the product is amalgamated and milled before plodding, plodding is conducted under vacuum, and the cut lengths of the bar are pressed to desired cake form.

A search of the prior art has resulted in the finding of various patents and publications which, while they refer to detergent laundry bars and to bar products containing higher fatty alcohol sulfate detergents, do not make the present invention obvious to one of skill in the art. Among the more relevant of these are: British patent specifications Nos. 836,939; 941,988; 1,155,726; 1,191,721; and 1,191,722; Detergent Age, September 1965, pages 20, 21; and Schimmel Briefs, No. 364 (July, 1965). In some such disclosures the employment of sodium alkyl sulfate in detergent bars is mentioned and the disadvantages of such products are described. Detergent laundry bars based on alkylbenzene sulfonates are mentioned and various other detergents which may be employed, including alkyl sulfates, are referred to, together with adjuvants, such as higher fatt acids, higher fatty acid alkanolamides, waxes, clays, bentonite, higher fatty alcohols and higher fatty esters. However, the mentioned references do not describe, suggest or make obvious, either alone or in combination, the built detergent laundry bars of the present invention, based on higher fatty alcohol sulfate detergent built with inorganic builder salt, such as sodium tripolyphosphate and sodium carbonate, and "bodied" with water insoluble powder, such as calcium carbonate, containing the described ethanolamide with glycerine, which are of improved handling, foaming, hardness, non-eroding and processing characteristics. Furthermore, none of such references, alone or in combination, discloses or makes obvious any combination of sodium coco alcohol sulfate, sodium tripolyphosphate, sodium carbonate, calcium carbonate, higher fatty lower alkanolamide, glycerol and water in a detergent laundry bar. The closest publication known to applicants is U.S. Pat. No. 4,543,204, which, unlike the present invention, utilizes a higher fatty acid as a plasticizer, and describes the presence of alkanolamide, too (but does not mention glycerol).

The higher fatty alcohol sulfate, which is the primary detergent component of the present laundry bars, is one in which the higher alcohol or alkyl group is normally in the range of 10 to 18 carbon atoms. The cation will almost invariably be sodium or will include sodium, although other cations, such as triethanolamine (most preferred, after sodium), potassium, ammonium, magnesium and calcium, may also be present, usually in minor proportion, with the sodium detergent normally constituting more than 50%, preferably more than 75% and most preferably all or substantially all of the higher fatty alcohol sulfate content of the laundry bar.

Other synthetic organic anionic detergents of the sulfated and/or sulfonated types (and in some cases nonionic and/or amphoteric detergents) may also be present in the laundry bar as secondary detergents but the total amounts of such secondary detergents will normally be only minor, with respect to the higher fatty alcohol sulfates. Among the secondary detergents those which are preferred, especially when biodegradability is desirable, include higher fatty alcohol ethoxylate sulfates, the higher fatty acid monoglyceride sulfates of 10 to 18 carbon atoms in the fatty acyl moieties, the paraffin sulfonates, olefin sulfonates and alpha-sulfo-higher fatty acid methyl esters. Sometimes some branched and linear alkylbenzene sulfonates of 10 to 18 carbon atoms in the lipophilic groups thereof, may be present, with the more biodegradable members of the alkylbenzene sulfonate class being more preferred. The higher fatty acid soaps may also be incorporated in these products, usually in minor proportions, and mixtures of the various secondary detergents with each other and/or with soaps and with the principal higher fatty alcohol sulfate detergent may be utilized. The various secondary detersive components of the laundry bars will normally be employed as their water soluble salts, and preferably will be sodium salts. Mixtures of different types of salts may be employed, as may be mixtures of the detergents. Normally the higher fatty acyl or alkyl groups of the detergents will be mixtures but essentially pure starting materials may also be employed, so that the detergent, whether a primary or secondary detersive component of the products, may include a lipophilic group, or such groups of essentially the same chain length(s).

Preferred higher fatty alcohol sulfates are those wherein the fatty alcohol is essentially saturated and is of carbon content(s) within the 10 to 18 carbon atoms range, preferably 10 or 12 to 14 or 16 carbon atoms, such as 12 to 16, or that derived from coconut oil (coco), palm oil, or palm kernel oil. Lauryl sulfates, and particularly, sodium lauryl sulfate, are preferred primary detergents but such designation also may apply to such detergents wherein the carbon chain length of the alcohol is not limited to 12 carbon atoms, but is primarily (over 50% and normally over 70 or 75%) of 12 to 14 carbon atoms. Such materials may be obtained from natural sources, such as coconut oil and palm kernel oil, or may be synthesized, as from petroleum products. Sometimes it will be preferred to employ what is characterized as a broad cut of fatty alcohol covering the $C_{10-18}$ range, such as one analyzing about 0.3% of $C_{10}$, 48 to 58% of $C_{12}$, 19 to 24% of $C_{14}$, 9 to 12% of $C_{16}$, and 5 to 13% of $C_{18}$ fatty alcohols. While saturated alcohols are highly preferred as sources for the present detergent, some unsaturated alcohols, normally less than 20% of the total content, may also be present.

Among the secondary detergents the higher fatty alcohol ethoxylate sulfate is preferred. It is preferably of a fatty alcohol which is essentially saturated and of a carbon atom chain length within the 10 to 18 carbon atoms range, often more preferably of 12 to 16 or 12 to 15 carbon atoms. In fact, the various specifications set forth in the previous paragraphs with respect to the higher fatty alcohol sulfate apply too, as applicable, to the higher fatty alcohol of the ethoxylate sulfate. The cation of the ethoxylate sulfate will also be like the cation(s) described previously for the alcohol sulfate but different cations for the alcohol sulfate and the ethoxylate sulfate and mixtures of cations for each may be utilized, too. The ethoxy chain of the ethoxylate sulfate may be of 1 to 20 ethoxy group(s), preferably being of 3 to 8 ethoxy groups, and more preferably it is of about 3 ethoxy group(s).

Various water soluble builder salts, usually as sodium salts, may be incorporated in the invented laundry bars. Of these the most important are the phosphates, particularly the polyphosphates, such as sodium tripolyphosphate and sodium pyrophosphate. Sodium orthophosphate may be employed, usually in minor proportion with respect to the polyphosphate(s). Other builder salts, of the chelating or precipitating types, inorganic and organic, may also be used, such as sodium carbonate, sodium silicate, normally of $Na_2O:SiO_2$ ratio in the range of 1:1.6 to 1:3, preferably 1:2 to 1:3, and more preferably 1:2 to 1:2.4, borax, and sodium bicarbonate. Other builders, including organic builders, such as trisodium nitrilotriacetate (NTA), sodium polyacrylate, sodium citrate and sodium polyacetal carboxylate may be used, as may be other water soluble salts of the corresponding acids.

In addition to the water soluble builders, some water insoluble builders may also be employed, such as detergent building calcium ion exchanging zeolites, including hydrated zeolites A, X and Y, e.g., Zeolite 4A, containing about 20% of water of hydration. Such materials also may act as bodying agents and can improve processability but while such other desirable properties can be of some importance, herein the zeolites will be considered as builders, and will be included in the proportions specified for builders.

Various mixtures of builders may be employed to make the laundry bars of this invention but it is highly preferable that the primary builder be pentasodium tripolyphosphate, preferably hydrated and high in type I crystal form. It has been found that such hydrated polyphosphate, which preferably is hydrated during working in with the other detergent laundry bar components, including water, contributes to improvement of the ease of working, strength and uniform extrusion of the present laundry detergent bars. In addition to functioning as a builder, sodium silicate, when present, can act as a binder for the other components and can help to prevent corrosion of aluminum and other metals by the other detergent bar components. Sodium carbonate has bodying properties too, as does borax.

Water insoluble particulate material components of the present bars, hereafter usually referred to as bodying agents, although they may also perform other functions in the bars, contribute significantly to the formation of a firm, yet processable laundry bar, and help to regulate the release of detergent from the bar during use. While any of many insoluble materials, usually inorganic and mineral, may be employed, such as clays, talc, calcium silicates, magnesium silicate, calcium sulfate, silica, calcium phosphate, and calcium carbonate, the most important of such materials is calcium carbonate, and talc is usually considered to be the next best such bodying agent. Talc, a natural yydrous magnesium silicate, is especially useful for promoting processing ease, improving the feel of the laundry bar, helping to improve its storage characteristics and making a better foam or lather, in conjunction with the other components of the bar. Bentonite, preferably as sodium bentonite, may also be used and has the advantage of functioning as a fabric softening agent for the laundry. It may also be a processing aid.

The calcium carbonate, talc, bentonite and the other insoluble (and often soluble materials, too) will normally be in finely divided form, often with all or substantially all, e.g., over 99%, passing through a No. 200 sieve (U.S. Sieve Series) and sometimes through a No. 325 sieve.

Instead of the mentioned insoluble bodying agents it has been found that sodium sulfate, which is water soluble, may sometimes be employed, preferably when it is of particle sizes like those given in the preceding paragraph, and often when it is mixed with the insoluble bodying agents.

In the described laundry detergent bars there will also be present, to inhibit breakage on handling, a combination of glycerol and higher fatty lower alkanolamide, preferably a higher fatty acid(s) alkanolamide wherein the higher fatty acid(s) is/are of 10 to 18 carbon atoms, preferably of 12 to 14 or 16 carbon atoms, e.g., lauric acid, myristic acid or coco acid, and the lower alcohol is of 1 to 4 carbon atoms, preferably 1 to 3 carbon atoms, more preferably 1 to 2 carbon atoms and most preferably ethanol. The alkanolamides may be monoalkanolamides or dialkanolamides, but the monoalkanolamides are preferred, especially cocomonoethanolamide. When alkanolamide is present but glycerol is omitted the detergent laundry bar made does not resist breakage on storage to the extent desired; similarly, glycerol alone, without the alkynolamide, does not prevent such breakage. According to applicant's test results, a combination of the alkanolamide and glycerol is needed to obtain the unexpectedly beneficial stabilizing results.

Fatty acids of 10 to 18 carbon atoms, preferably primarily of 12 to 14 carbon atoms, e.g., coco fatty acids, may be used to improve the resiliency of the present bars and to prevent breakage thereof on storage and during shipment, as described in U.S. Pat. No. 4,543,204, but it is a feature of this invention that such are not required, and sometimes they are preferably avoided.

Various adjuvants may be employed in the present detergent laundry bars for their individual desirable effects. Among such adjuvants are: fatty acids, as mentioned above; binders, such as gums, e.g., carrageenan and alginates, starches and modified starches; plasticizers, such as higher fatty alcohols, e.g., cetyl alcohol, lauryl alcohol; colorants, such as dyes and pigments, e.g., Polar Brilliant Blue dye and ultramarine blue pigment; fluorescent brighteners, such as stilbene brighteners; whitening agents, such as titanium dioxide (anatase); antioxidants, e.g., benzohydroxytoluene; perfumes; anti-redeposition agents, e.g., sodium carboxymethylcellulose (which also may have binding properties); enzymes, e.g., protease, amylase; bactericides; fungicides, and solvents.

In addition to the above components water will be present in the laundry bar. While it is preferred to employ deionized water, tap water or city water may be utilized, preferably with the hardness content thereof being no more than 200 parts per million, as calcium carbonate, and more preferably with such hardness being less than 100 or 50 p.p.m. The water serves as a mutual solvent and plasticizing agent for various components of the detergent bar and facilitates desirable hydration of some of the hydratable materials, such as sodium polyphosphate, sodium pyrophosphate, sodium carbonate, sodium sulfate, bentonite and starch (when present). In conjunction with detergents, binders, bodying agents and/or hydratable salts present, plus some adjuvants, the water tends to facilitate processing, such as milling and plodding, and helps to maintain the detergent bar sufficiently strong so that it will resist cracking and breakage on shipment after manufacture and storage. It appears that any of the higher fatty acid present may inhibit evaporation of moisture from the laundry bar, thereby helping to keep the bar in stronger condition on storage. The alkanolamide and fatty alcohol, if the latter is also present, may also have such an effect.

The proportions of the various components in the final detergents are approximately the same as those in the mixture of materials being formulated (usually in an amalgamator) for milling and plodding because relatively little moisture is lost in such operations. Normally the moisture loss will be between 0.5 to 3%, and most of the time the loss will be between 1 and 2%, e.g., 1.5%. It appears during the mixing or subsequent operations that the composition is insufficiently plasticized due to low water content, additional water may be employed, which is usually added to the amalgamator, sigma-type mixer or other suitable mixing or blending device, with the various other components of the laundry bar.

The final bar will have a total content of the higher fatty alcohol sulfate which will be in the range of 10 to 35%, preferably 10 to 30%, and more preferably 10 to 25%, e.g., 15%, 23%. Secondary detergent content will be held to 5 or 10%. Total builder content will normally be in the range of 10 to 60%, preferably 20 to 50%, and sometimes more preferably 30 to 45%, and it will often be preferred that the builder be inorganic water soluble salt, such as a mixture of sodium tripolyphosphate, sodium carbonate and sometimes, sodium silicate ($Na_2O$:-$SiO_2$=1:2.4) also. The percentage of bodying agent present will normally be in the range of 10 to 60%, preferably 10 to 50% and more preferably 12 to 45%. The ranges of percentages of water in the bar, which includes water removable from any hydrate components when the bar is subjected to heating at 105° C. for two hours, following a normal moisture analysis procedure, will normally be 5 to 20%, preferably 5 to 15%, more preferably 5 to 12%, and sometimes most preferably 7 to 10%, e.g., about 9%. With respect to individual builders and bodying agents it will often be preferred that the builders include 15 to 30% of sodium tripolyphosphate, 5 to 25% of sodium carbonate and 0 to 10% of sodium silicate, more preferably 20 to 25%, 10 to 20%, and 0 or 2 to 5%, respectively, e.g., about 20 or 25% of sodium tripolyphosphate, about 0% or 20% of sodium carbonate and about 0 or 3% of sodium silicate. The bodying agent, preferably water insoluble powder, will preferably comprise 10 to 50% of calcium carbonate powder and 0 to 15% of talc, and more preferably 14 to 45% of calcium carbonate, e.g., about 14%, 17%, 22%, 40% or 45%.

The content of alkanolamide will be in the range of 1 to 10%, preferably 3 to 10%, and more preferably 3 to 7%, e.g., about 5%. The content of glycerol will be in the range of 0.2 to 5%, preferably 0.2 to 2% and more preferably 0.3 to 1%, e.g., about 0.5%. The ratio of alkanolamide:glycerol will be in the range of 1:5 to 25:1, preferably 1:2 to 20:1 and more preferably, 2:1 to 20:1, e.g., about 10:1.

Adjuvant content will usually be limited to 5% and preferably will be limited to 3%. Thus, the proportion of adjuvants present may be in the range of 0.5 to 3 or 5%, e.g., about 1 or 2%. Moisture content will usually be in the range of 5 to 20%, preferably 5 to 15%, more preferably 5 to 10 or 12%, e.g., about 8 or 9%.

The invented detergent laundry bars can be processed with available equipment of types used for manufacturing soap and detergent bar products. Initially, a heavy duty amalgamator or mixer, such as one equipped with sigma-type blades or one equipped with counter-rotating paddle type agitators, is used to mix the various components, most of which are powdered but some of which may be in liquid state, sometimes as aqueous solutions. The order of addition of the various components of the laundry bars is not considered to be important so long as reasonable care is taken to prevent complete or premature hydration of the phosphate (and any other hydratable components which desirably hydrate during working of the composition) and any excessive lumping which could occur in the mixing process due to such premature and/or uneven hydration. The mixing may take only a short time, but can take from one minute to an hour, with the usual mixing time being from 2 to 15 minutes. The mixed product will desirably be in separable solid form at about room temperature and will be charged, preferably by means of a multi-worm transfer conveyor (preferably equipped with cooling means), to a multi-rolled mill, such as a five-roll Lehmann mill of the soap mill type. The mill will be equipped with means for heating or cooling and normally the cooling means will be employed to maintain the ribbon temperature from the mill within the range of about 30° to 40° or 45° C. Various ribbon and chip thicknesses may be employed but usually such thicknesses will be in the range of 0.1 to 1 mm., preferably 0.2 to 0.4 or 0.5 mm. However, other thicknesses may be employed, depending on particular formulations being milled, so long as the composition is satisfactorily homogenized on the mill and providing that any coarse particles that may be present are pulverized so that the finished product is not objectionably gritty.

The milled chips or milled material in other form is then conveyed to a double stage vacuum plodder, operating under a higher vacuum, e.g., 600 to 740 millimeters of mercury vacuum, in which any entrapped air is evacuated. The mass of laundry detergent composition is worked in the plodder and is extruded from it as a bar. The plodder is equipped with a heated nozzle which softens the composition immediately prior to extrusion, allowing the production of a uniform and homogeneous bar. Such bar may be cut to length and impressed with a product brand name by means of a combination of rotary cutter and imprinter, or it may be cut to lengths, called blanks, and may be stamped to shape in a press. Before pressing, the blanks may be cooled in a cooling tunnel. If not to be pressed, the cut lengths are cooled before wrapping. In either case the cooled bars are automatically wrapped, cased and sent to storage, prior to shipping.

The previous description is one for the manufacture of the laundry detergent bars of this invention wherein the anionic detergent(s) is/are added to the mixer in powder, flake, liquid or paste form. However, appropriate detergents, such as the higher fatty alcohol sulfate, may also be made in situ by the neutralization of the appropriate corresponding detergent acid(s) with soda ash or other suitable neutralizing agent. Such a reaction can result in the production of sodium sulfate from any excess sulfuric acid that may be present with the detergent acid, or, if excess soda ash or other sodium base is employed, such or a salt thereof may be in the product. Unreacted higher fatty alcohol or other corresponding lipophile may also be present with the detergent(s). Such materials, the sodium sulfate, sodium carbonate or other builder salt, and the lipophile, may all be useful components of the present laundry bars. The described neutralization reaction may be effected in a separate reactor, but it may also be conducted in the mixer to be employed for mixing the other laundry bar constituents with anionic detergent(s).

The detergent laundry bars made in accordance with this invention have properties that are superior to those of detergent laundry bars based on the higher fatty alcohol sulfate, when alkanolamide and glycerol are omitted from the product, and such superiority was previously referred to herein. It has also been demonstrated in the working examples. Thus, from this description it is seen that the various components of the laundry bars, especially the alkanolamide and glycerol, interact and contribute to the final desirable properties of the product in several ways. The result is that an improved synthetic organic detergent laundry bar has now been made that includes higher fatty alcohol sulfate but is stronger, harder, of better foaming properties (in hand washing of laundry), and of a lesser tendency to slough or erode in use, compared to many higher fatty alcohol sulfate bars made of other formulas. In addition it processes better, much like soap.

The following examples are given to illustrate the invention but are not to be considered as limiting it. Unless otherwise indicated, all temperatures are given in °C. and all parts and proportions are by weight.

| Components | Percentages | | | |
|---|---|---|---|---|
| | A | B | C | D |
| Sodium coco fatty alcohol sulfate | 15.0 | 23.0 | 15.0 | 23.0 |
| Sodium tripolyphosphate (high in Phase I content) | 20.0 | 25.0 | 20.0 | 25.0 |
| Sodium carbonate, anhydrous | 10.0 | 20.0 | 10.0 | 20.0 |
| Sodium silicate ($Na_2O:SiO_2$ = 1:2.4) | — | — | — | 3.0 |
| Calcium carbonate, powdered (through No. 200 sieve, U.S. Sieve Series) | 39.6 | 16.6 | 39.6 | 13.6 |
| Cocomonoethanolamide | 5.0 | 5.0 | — | — |
| Cocodiethanolamide | — | — | 5.0 | 5.0 |
| Glycerol | 0.5 | 0.5 | 0.5 | 0.5 |
| Pigment, white (titanium dioxide, finely powdered) | 0.5 | 0.5 | 0.5 | 0.5 |
| Optical brightener (stilbene type) | 0.1 | 0.1 | 0.1 | 0.1 |
| Perfume | 0.3 | 0.3 | 0.3 | 0.3 |
| Water | 10.5 | 10.5 | 10.5 | 10.5 |
| water loss in processing | 1.5 | 1.5 | 1.5 | 1.5 |
| | 100.0 | 100.0 | 100.0 | 100.0 |

Detergent laundry bars of the formulas given (with 1.5% extra water to compensate for that lost in mixing, milling and plodding) are made by a process which includes the steps of mixing, milling, plodding, cutting to lengths and (optionally) pressing to shape. Mixing is effected in a conventional soap or detergent amalgamator or mixer having a sigma-type mixing blade. The order of addition of the components is not critical but the sodium tripolyphosphate, which is hydratable, is added near the end of the mixing, shortly before the milling or equivalent working. This is done to improve uniformity of hydration of the polyphosphate in homogeneous contact with other bar components, which helps to strengthen the final bar. In the mixing operation described, the various liquid components of the formula are first added to the mixer, followed by the sodium cocoalkyl sulfate and any other particulate or powdered components. Mixing takes only a brief time, about five minutes, which is intentional so as to inhibit complete hydration of the polyphosphate. The contents of the mixer are fed by multiworm conveyor to a five-roll mill of the Lehmann type, wherein the mix is converted to ribbon and chip form. The multi-worm transfer conveyor is equipped with cooling means so as to prevent excessive sticking of the mixture to the conveyor parts.

The mill, which is also equipped with cooling means, operates at such a temperature that the final chip is at a suitable temperature, in the range of about 35° to 42° C., but in some instances higher or lower temperatures may be employed. The chip thickness is maintained in the range of 0.2 to 0.4 mm. The milled chips are then fed to a double stage vacuum plodder, which operates at a vacuum of about 700 mm. of mercury, to remove any entrapped air and to work the composition and extrude it as a bar through a heated nozzle, wherein the composition is heated sufficiently to facilitate extrusion as a homogeneous bar. The bar is then cooled to a suitable pressing temperature, preferably in the range of 20° to 30° C., and is pressed to final bar or cake shape, following which it is automatically wrapped, cased and sent to storage, for subsequent shipment and sale to the ultimate consumer. Alternatively, instead of being pressed to shape, the bars are cut or essentially simultaneously cut and "printed" with a company name or other indicia, in which case the mentioned cooling may be effected after cutting and/or "imprinting".

The milling and plodding proceed well, with power requirements being substantially like those for manufacturing soap bars, and the bars made appear to be homogeneous. The bars are evaluated by expert evaluators and by consumers and are found to be of satisfactory utilitarian and aesthetic characteristics. Particularly, the bars are found to foam, refoam, and persist in foaming satisfactorily, to feel good to the hands of the user, to clean well, to be sufficiently hard, and not to erode or slough excessively during use (so that they are not consumed too quickly). Also, it is noted that the invented bars that are subjected to handling like that normally encountered in commercial distribution do not crack, break, powder or disintegrate so as to be unsatisfactory, whereas prior detergent laundry bars, based on higher fatty alcohol sulfate alone as the synthetic organic detergent component (and without fatty acids or other plasticizers being added), did not possess sufficient resistance to breakage, during storage and transportation, so as to be commercially acceptable.

The foaming tests run to evaluate the invented bars (and controls, which will be discussed later) accurately reflect actual use conditions of the present laundry bars. In such a use the items to be washed are wet and then are rubbed, on a washboard, with the laundry bar. After rubbing enough detergent composition into the item to be cleaned, the item is rubbed on the washboard or other hard surface until any dirt, soil or stain is removed. It is then rinsed and sometimes is re-treated. The washboard may be in a sink, pan, tub, pail, drum or other suitable container which will hold the wash water. After washing the first item of laundry additional items will be wet in the wash water and then rubbed on the washboard, sometimes with the application of additional detergent composition from the laundry bar, and sometimes without such application. It is important to the consumer, andtherefore it is important to the manufacturer, that in this second washing and in any further washings with the same wash water, the wash water will still generate a substantial amount of foam as the laundry is moved through it, while the laundry is being rubbed on the washboard.

In a test devised to yield data corresponding to that from such hand washing processes, a pair of counter-oscillating washing machine-type agitators, but on a reduced scale, is mounted vertically and spaced apart, so as to agitate water in a plastic container that measures 34.3 cm. long×29.2 cm. wide×13.3 cm. high. A piece of towelling, such as a nubby face cloth, with holes cut in it to allow it to fit over vertical drive shafts for the agitators, rests on the tops of the agitators, each of which is of a generally flat truncated cone shape, with three equidistant vertical ribs. As the agitators move, the towelling twists and untwists, simulating the motions in the wash water of laundry being scrubbed. To start the test, three liters of a solution of the laundry bar being tested (or of the components of such a bar) are made, with the composition concentration being 2.5 g./l., and with the wash water used being 150 p.p.m. hardness (mixed calcium and magnesium hardness, as $CaCO_3$). The foam height is measured after five minutes agitation, after which the water is allowed to rest for two minutes, with the height then again being read, and then agitation is resumed for another five minutes, and a third foam height reading is taken. By such tests it has been established that the foam height after refoaming is an excellent indication of the overall foaming capability of a product, including its initial and "after rest" foaming, too. Therefore, such refoaming heights will be given here. They are 5.5 cm., 6.0 cm., 5.0 cm. and 6.0 cm., respectively (1A–1D). Thus all four types of bars made according to this invention are satisfactorily foaming for hand washing of laundry. All four experimental products are also non-brittle, as determined by a single drop test after one month's storage, in which standard right parallelepiped-shaped detergent laundry bars made according to Formulations A–D of Example 1 are dropped in free falls of four feet (1.22 meters) onto a standard wooden block. None of the bars breaks or deforms to a noticeable extent when subjected to this test. The hardnesses of the bars of Experiments 1A–1D were evaluated by several experimental evaluators for detergent bar products, and all found them to be satisfactorily hard. Erosion or sloughing tests were run by allowing the bars to soak in water for two hours, after which any soft gel product was removed by wiping. The percentages of the bars remaining after the tests were 84%, 88%, 78% and 82%, respectively, all considered to be satisfactory.

EXAMPLE 2

(Comparative Example)

| | A | B | C | D | E | F |
|---|---|---|---|---|---|---|
| Components | | | | | | |
| Sodium coco fatty alcohol sulfate | 15 | 15 | 15 | 23 | 23 | 23 |
| Sodium tripolyphosphate (high in Phase I content) | 20 | 20 | 20 | 25 | 25 | 25 |
| Sodium carbonate, anhydrous | 10 | 10 | 10 | 20 | 20 | 20 |
| Calcium carbonate, powdered (through No. 200 sieve, U.S. Sieve Series) | 45.1 | 40.1 | 44.6 | 22.1 | 17.1 | 21.6 |
| Cocomonoethanolamide | — | 5 | — | — | 5 | — |
| Glycerol | — | — | 0.5 | — | — | 0.5 |
| Pigment, white (titanium dioxide, finely powdered) | 0.5 | 0.5 | 0.5 | 0.5 | 0.5 | 0.5 |
| Optical brightener (stilbene type) | 0.1 | 0.1 | 0.1 | 0.1 | 0.1 | 0.1 |
| Perfume | 0.3 | 0.3 | 0.3 | 0.3 | 0.3 | 0.3 |
| Water | 10.5 | 10.5 | 10.5 | 10.5 | 10.5 | 10.5 |
| Water loss in processing | 1.5 | 1.5 | 1.5 | 1.5 | 1.5 | 1.5 |
| Test Results (tests described in Example 1) | | | | | | |
| Brittleness (B = brittle; NB — non-brittle) | B | B | B | B | B | B |
| Foaming (5 minutes reagitation, cm.) | 2 | 5 | 2 | 5 | 5.5 | 5 |
| Bar hardness (A = acceptable) | A | A | A | A | A | A |
| Bar erosion (% bar remaining) | 65 | 82 | 78 | 64 | 82 | 84 |

In the above experiments, 2 A-F, which are essentially repetitions of the experiments of Example 1, using formulas like those given in such example except for omitting one or both of the alkanolamide and/or glycerol from the formulas, all the control bars are found to be objectionably brittle after one month's storage. Thus, it has been shown that when alkanolamide and glycerine, within the described proportions, are present in built detergent laundry bars based on higher fatty alcohol sulfate detergent, the bars produced are non-brittle on storage and handling, but when either the alkanolamide or the glycerol or both is/are absent, the bars are unacceptably brittle, and break when subjected to normal handling forces. Also, the experimental bars of Example 1 are generally better in resistance to sloughing and erosion than the control bars of Example 2, especially those containing no alkanolamide and no glycerol, and are also better in foaming than the control bars, especially such control bars which contain no alkanolamide and no glycerol.

EXAMPLE 3

When other compositions within the invention are made, of the same formulas as those of Example 1, except for the employment of an additional 5% of sodium higher fatty alcohol ethoxylate sulfate wherein the higher fatty alcohol is of an average of 12 to 15 carbon atoms and the ethoxylate is of 3 ethylene oxide groups per mole, with the proportion of calcium carbonate being reduced by 5% to compensate for the addition of the secondary detergent, the detergent laundry bars resulting are of improved foaming ability and are even more resistant to breakage in handling are than the bars of Example 1. Similar results are obtainable when, instead of the sodium coco fatty alcohol sulfate of Example 1, the corresponding triethanolamine or potassium salt is employed as a part of the alcohol sulfate detergent content, e.g., about $\frac{1}{4}$ thereof. Such results are also obtainable when instead of the sodium coco fatty alcohol sulfate the corresponding detergent derived from tallow alcohol, dodecanol or cetyl alcohol, or a mixture thereof, is employed. Similarly, the anion of the secondary detergent may be lower alkanolamine, potassium or other soluble salt-former, instead of sodium. Other secondary detergents, such as sodium cocomonoglyceride sulfate and sodium paraffin sulfonate, may be substituted for the ethoxylate sulfate detergent. Similarly, the primary detergent, the alcohol sulfate, may be made from palm alcohol or palm kernel alcohol instead of from coco alcohol, or equivalent natural based materials may be employed, and similar results will be obtained.

EXAMPLE 4

When in the preceding examples the proportions of the various components of the invented formulas (excluding the control formulas) are varied, ±10%, ±25%, while being maintained within the ranges recommended in the specification, satisfactory improved detergent laundry bars, having the previously described favorable properties, are also obtainable. Similarly, when other builders, such as sodium NTA, sodium citrate, polyacetal carboxylate, borax and sodium bicarbonate, are employed in partial replacements, e.g., $\frac{1}{4}$, of the sodium tripolyphosphate and sodium carbonate, individually or taken together, acceptable detergent laundry bars having the desirable properties previously mentioned can be made. Such is also the case when talc is substituted for approximately $\frac{1}{4}$ of the content of calcium carbonate in the formula and when up to $\frac{1}{4}$ of the calcium carbonate is replaced by sodium sulfate. Alternatively, bentonite, synthetic calcium silicate, pumice and tricalcium phosphate may be substituted for a part, up to ⅓ of the insoluble bodying agents of the formulas of Example 1. The adjuvants employed may be omitted, and functionally acceptable detergent bars are obtainable, but without the adjuvants' properties, and if desired, other adjuvants may also be present although the proportion thereof should usually not exceed 5% of the total bar.

In the manufacture of the described detergent laundry bars the milling operation may be omitted, with the plodding being utilized to work the composition sufficiently to produce coherent and homogeneous bar products. However, bar quality will not usually be as good as when milling is employed. Similarly, the components of the product may be pressed to bar form without milling and plodding but the product resulting is usually not as strong and may be considered unsatisfactory in physical properties. Instead of employing cocomonoethanolamide or cocodiethanolamide there may be utilized lauric myristic diethanolamide, lauric monoethanolamide, cocomonoisopropanolamide and/or cetyl monoethanolamide, at least to the extent of ⅓ of the ethanolamide content of the product. Similarly, mixtures of various of such alkanolamides may be employed. When glycerol is present with the alkanolamide improvements like those previously described with respect to resistance to breakage, resistance to erosion, foaming capacity, and hardness are attainable.

The invention has been described with respect to examples and illustrations thereof but it is not to be limited to these because it is evident that one of skill in the art, with the present specification before him, will be able to utilize substitutes and equivalents without departing from the invention.

What is claimed is:

1. A detergent laundry bar based on higher fatty alcohol sulfate detergent, which is of improved physical characteristics, including resistance to breakage on handling, which consists essentially of 10 to 35% of higher fatty alcohol sulfate detergent, 10 to 60% of builder for the detergent mixture, a bodying proportion, in the range of 10 to 60% of water insoluble powder, 1 to 10% of higher fatty lower alkanolamide, 0.2 to 5% of glycerol, with the ratio of alkanolamide to glycerol being in the range of 1:5 to 25:1, and 5 to 20% of water, which water includes water removable from any hydrate components of the detergent laundry bar when such bar is subjected to heating at 105° C. for two hours.

2. A plodded detergent laundry bar according to claim 1 which consists essentially of 10 to 30% of sodium higher fatty alcohol sulfate wherein the higher fatty alcohol is of 10 to 18 carbon atoms, 20 to 50% of water soluble inorganic builder salt, which salt comprises alkali metal tripolyphosphate and/or alkali metal pyrophosphate and/or alkali metal carbonate and/or alkali metal silicate, 10 to 50% of water insoluble powder which comprises calcium carbonate and/or talc, 3 to 10% of higher fatty ethanolamide wherein the higher fatty moiety is of 10 to 18 carbon atoms, 0.2 to 2% of glycerol, with the ratio of ethanolamide:glycerol being in the range of 1:2 to 20:1, and 5 to 15% of water.

3. A detergent laundry bar according to claim 2 which consists essentially of 10 to 25% of sodium higher fatty alcohol sulfate, in which the higher fatty alcohol is of 12 to 16 carbon atoms, 15 to 30% of sodium tripolyphosphate, 5 to 25% of sodium carbonate, 0 to 10% of sodium silicate, 10 to 50% of calcium carbonate powder, 3 to 7% of cocomonoethanolamide, 0.3 to 1% of glycerol, with the ratio of cocomonoethanolamide:glycerol being in the range of 2:1 to 20:1, and 5 to 12% of water.

4. A milled and plodded detergent laundry bar according to claim 3 which consists essentially of about 15% of sodium coco alcohol sulfate, about 20% of sodium tripolyphosphate, about 10% of sodium carbonate, about 40% of calcium carbonate powder, about 5% of cocomonoethanolamide, about 0.5% of glycerol, and about 9% of water.

5. A milled and plodded detergent laundry bar according to claim 3 which consists essentially of about 23% of sodium coco alcohol sulfate, about 25% of sodium tripolyphosphate, about 20% of sodium carbonate, about 17% of calcium carbonate powder, about 5% of cocomonoethanolamide, about 0.5% of glycerol, and about 9% of water.

6. A plodded detergent laundry bar according to claim 2 which consists essentially op about 23% of sodium coco alcohol sulfate, about 25% of sodium triployphosphate, about 20% of sodium carbonate, about 3% of sodium silicate of $Na_2O:SiO_2$ ratio of about 1:2.4, about 14% of calcium carbonate powder, about 5% of cocodiethanolamide, about 0.5% of glycerol and akjbout 9% of water.

* * * * *